US009000938B2

(12) United States Patent
Hölzer

(10) Patent No.: US 9,000,938 B2
(45) Date of Patent: Apr. 7, 2015

(54) SAFETY SYSTEM COMPRISING SMOKE DETECTOR AND SIGNALING MEANS

(75) Inventor: Bernd Hölzer, Mannheim (DE)

(73) Assignee: PWI-Pure System AG, Mannheim (DE)

( * ) Notice: Subject to any disclaimer, the term of this patent is extended or adjusted under 35 U.S.C. 154(b) by 73 days.

(21) Appl. No.: 14/009,613

(22) PCT Filed: Apr. 10, 2012

(86) PCT No.: PCT/EP2012/056453

§ 371 (c)(1),
(2), (4) Date: Oct. 25, 2013

(87) PCT Pub. No.: WO2012/136847

PCT Pub. Date: Oct. 11, 2012

(65) Prior Publication Data

US 2014/0049400 A1 Feb. 20, 2014

(30) Foreign Application Priority Data

Apr. 6, 2011 (DE) ..... 20 2011 005 648 U
Oct. 31, 2011 (DE) ..... 10 2011 117 293
Dec. 15, 2011 (DE) ..... 10 2011 121 137

(51) Int. Cl.
*G08B 7/00* (2006.01)
*G08B 17/10* (2006.01)
(Continued)

(52) U.S. Cl.
CPC . *G08B 17/10* (2013.01); *F21S 8/04* (2013.01); *F21V 33/0076* (2013.01); *F21Y 2105/00* (2013.01); *F21V 29/15* (2015.01)

(58) Field of Classification Search
CPC ..... G08B 13/00; G08B 17/103; G08B 5/36; G08B 17/10
USPC ..... 340/693.5, 506, 513, 628, 693.6, 340/693.11; 362/147, 404
See application file for complete search history.

(56) References Cited

U.S. PATENT DOCUMENTS 2,682,855 A 7/1954 Gerace
3,409,885 A 11/1968 Hall
(Continued)

FOREIGN PATENT DOCUMENTS

AT 502 655 A4 5/2007
DE 3420188 A1 12/1985
(Continued)

*Primary Examiner* — Phung Nguyen
(74) *Attorney, Agent, or Firm* — Hudak, Shunk & Farine Co. LPA

(57) ABSTRACT

A console including one or more light-emitting devices that are intended to be combined with one or more identical or different signalling devices. The console has at least one first frame element including an upper part with a front side and a lower part with a rear side that is intended to be mounted to a mounting surface, and a first light-emitting device that is directly or indirectly arranged on the frame element. The function of the signalling devices should not be adversely affected by the light-emitting devices while enabling a modular combination of such systems to increase safety. For this purpose, the frame element has at least two parts in the direction of a central axis (M). At least one groove is provided between the front side and the rear side, which groove extends at least partially around the central axis (M) on the outer side. The light-emitting device is arranged in the groove. The frame element has a recess with an inner side, which recess serves to accommodate an electrical signalling device, wherein the frame element insulates and shields the signalling device from the heat that is generated by the light-emitting device and is transferred by conduction or convection.

20 Claims, 2 Drawing Sheets

(51) Int. Cl.

| | |
|---|---|
| ***F21S 8/04*** | (2006.01) |
| ***F21V 33/00*** | (2006.01) |
| *F21Y 105/00* | (2006.01) |

(56) References Cited

U.S. PATENT DOCUMENTS

| | | | | |
|---|---|---|---|---|
| 4,090,178 | A | 5/1978 | Norris | |
| 4,227,191 | A * | 10/1980 | Raber | 340/628 |
| 4,812,827 | A * | 3/1989 | Scripps | 340/693.1 |
| 7,969,321 | B2 * | 6/2011 | Spellman | 340/693.6 |
| 2007/0257805 | A1 * | 11/2007 | Gaglianone | 340/584 |

FOREIGN PATENT DOCUMENTS

| | | | |
|---|---|---|---|
| DE | 199 04 933 | C1 | 4/2000 |
| DE | 200 02 364 | U1 | 5/2000 |
| DE | 10 2006 035 505 | A1 | 2/2008 |
| DE | 20 2011 005 648 | U1 | 10/2011 |
| WO | 2009 105168 | A1 | 8/2009 |
| WO | 2010054346 | A1 | 5/2010 |
| WO | 2011032059 | A1 | 3/2011 |

* cited by examiner

SAFETY SYSTEM COMPRISING SMOKE DETECTOR AND SIGNALING MEANS

FIELD OF THE INVENTION

The invention relates to a modular safety system including a console that is designed to accommodate identical or different signalling means, which system can in particular be used in case of fire. The safety system comprises a console including a light-emitting means, and a modular system that is provided for combination with different signalling means. The console itself consists of a frame element. The frame element comprises an upper part including a front side, a lower part including a rear side that is intended to be mounted to a mounting surface, and the light-emitting means that is directly or indirectly arranged on the frame element.

BACKGROUND OF THE INVENTION

A combination of a lamp with a signalling means that is designed as a smoke detector has already been described in DE 200 02 364 U1 and is illustrated in FIG. 2. The frame element serves as a support for the lamps in which a light-emitting means is arranged and which are suspended from the frame element.

AT 502655 A4 describes a ceiling lamp with an integrated smoke detector, which ceiling lamp comprises a heat-emitting light source. Here, an air intake pipe is provided that leads to the inside of the ceiling lamp. A temperature difference along the air intake pipe brings about a stack effect in the air intake pipe.

U.S. Pat. No. 4,090,178 A1 describes a combination of a smoke detector and a lamp, consisting of a housing that includes a bottom and side walls. The housing is open on the top. Opposite the top, a lamp holder is centrally arranged on the housing, which lamp holder also accommodates the smoke detector circuit.

SUMMARY OF THE INVENTION

The object of the invention is to improve such safety systems in such a manner that the function of the signalling means is not adversely affected by the light-emitting means while enabling a modular combination of such systems in order to increase safety.

According to the invention, the aforesaid object is achieved by designing the frame element in such a manner that it comprises at least two parts in the direction of a central axis and comprises at least one groove between the front side and the rear side, which groove extends at least partially around the central axis on the outer side. The light-emitting means is arranged in the groove. The frame element comprises a recess that extends parallel to the central axis and includes an inner side. The inner side defines the recess in the radial direction relative to the central axis. The recess serves to accommodate an electrical signalling means. According to the invention, the frame element insulates the signalling means from the heat that is generated by the light-emitting means and is transferred by conduction or convection.

The two-part design enables the light-emitting means to be incorporated into the frame element to such an extent that the signalling means, which is to be arranged centrally, can be entirely positioned in the shadow, i.e. shielded from the radiation emitted by the light-emitting means, by means of the frame element. This is particularly advantageous if the signalling means used is a smoke detector. For this purpose, the recess is preferably designed as a through opening that is arranged coaxial with the central axis, enabling the signalling means to be embedded in the frame element as much as possible in the direction of the central axis. According to the invention, the frame element is plate-shaped and is arranged closer to the mounting surface than the signalling means to achieve this aim.

As the light-emitting means is arranged in the continuous groove, it can also be arranged so as to extend around the frame element, either entirely or in segments. The specific design and arrangement of the light-emitting means depend on the intended function of the light-emitting means.

It is advantageous for the installation of the frame element and the mounting of the light-emitting means if the frame element is divided in such a manner that the upper part forms a first side wall of the groove and the lower part forms a second side wall of the groove. Preferably, the upper part and the lower part can be connected to each other at least in the axial direction of the central axis, wherein the groove can be divided in a plane perpendicular to the central axis due to said connection.

The frame element is made of a material whose thermal conductivity is not higher than 1 W/(m*K) or is at least 10 W/(m*K), so that both metal and plastic can be used. Good thermal conductivity means that the heat generated by the light-emitting means is quickly absorbed by the frame element and transferred to the air. The surface temperature is almost evenly distributed across the frame element. Depending on the amount of heat produced, the frame element could additionally be designed with cooling ribs to enlarge the surface and transfer even more heat while the radius remains the same. If thermal conductivity is low, the frame element insulates the heat generated by the light-emitting means, preventing the heat from being transferred towards the recess, up to the signalling means.

It can also be advantageous if the frame element comprises an insulation layer that is arranged in the radial direction, relative to the central axis, between an inner side of the frame element and the light-emitting means. In this way, the transfer of heat towards the signalling means is interrupted regardless of thermal conductivity.

According to the invention, a light-conducting component is supported in the groove, which component extends in the radial direction, relative to the central axis, between the two planes of the front and rear sides. The plane E1 extends on the front side and the plane E2 extends on the rear side, both perpendicular to the central axis. In this way, the position of the light-emitting means is used to transfer the light further in the radial direction. In addition, the component also transports heat away from the heat-sensitive signalling means. The component is connected to the front side of the frame element without or with a gap of max. 0.2 mm in the axial direction as well as in the radial direction relative to the central axis.

To prevent the signalling means, in particular the smoke detector or smoke alarm, from being affected by the light-emitting means, the invention proposes that the size of the front side and/or the mass of the frame element be dimensioned in accordance with the heat introduced by the light-emitting means, in such a manner that the surface temperature of the frame element is max. 46° Celsius on the front side when the ambient temperature is up to 20° Celsius.

The modular structure comprises the solution that the consoles can be connected to each other, either by means of the components themselves or by means of intermediate components, so as to achieve a direct or indirect mechanical and/or light-conducting connection. The components and the intermediate component are made of glass or a transparent plastic. In case of a modular structure, the components and intermediate components that are strung together and emit light form light corridors or signal lines, for example to indicate and illuminate an escape route.

The safety system comprises several consoles as well as components and intermediate components, and an electrical signalling means that is positioned in the respective recess. The signalling means is preferably designed as a smoke detector, a smoke alarm, as a lamp, as a loudspeaker or as a camera. According to the invention, no distinction is made between smoke detectors and smoke alarms. Other electrical or hydraulic signalling means may be motion detectors or serve to extinguish a fire. Depending on the function of the signalling means, it is flush with the front side of the console in the axial direction of the central axis or protrudes beyond the front side by a length of between 1 mm and 80 mm. Loudspeakers can be mounted so as to be flush with the front side, while smoke detectors and smoke alarms will protrude to facilitate the detection of smoke.

According to the invention, the modular system is connected to an electronic control unit, wherein at least one first signalling means can transmit an electronic signal to the electronic control unit and the electronic control unit causes a second signalling means to output an acoustic and/or optical signal. In this way, a logical link of the individual signalling means to each other can be achieved. Preferably, a smoke detector is arranged in the recess of one frame element and a loudspeaker is arranged in the recess of at least one other frame element, and an acoustic signal or a spoken command is generated and output via the loudspeaker if the electronic control unit receives an electronic signal from the smoke detector. In case of fire, a smoke detector detects smoke. A signal of the smoke detector to the electronic control unit provides information relating to the place where smoke is detected and possibly the type of said smoke. According to the information provided, the electronic control unit generates a spoken command or an acoustic signal in a loudspeaker arranged in another console. The acoustic signal serves to alert passers-by. The spoken command acoustically indicates the shortest escape route to passers-by.

In case of a combination of a console with a smoke detector or smoke alarm, an air gap of between 0.5 mm and 1.2 mm is advantageously provided between the frame element and the smoke detector or smoke alarm in any desired direction to physically separate the frame element, and thus the light-emitting means, from the smoke detector or smoke alarm.

For this purpose, one or several light-emitting means and/or lamp(s) advantageously change their characteristics in accordance with one or several signal(s) of a smoke detector. Such characteristics include in particular the colour of the light, the blinking frequency, the blinking phase and the brightness. The light-emitting means and/or lamps are used to optically signal the escape route to passers-by.

In this context, the characteristics of the light-emitting means and/or the lamps of at least one console may be controllable in accordance with the characteristics of the light-emitting means and/or the lamps of another console. In this way, a moving optical signal can be generated, for example along several consoles arranged along a path, since the light-emitting means and/or lamps of a first console light up or flash a few milliseconds before or after the adjacent console. A suitable connection in series of more than five consoles causes moving optical signals to be generated.

The electrical signalling means are designed to be accommodated in the recess and can be exchanged with each other within one console due to their identical or similar diameters.

BRIEF DESCRIPTION OF THE DRAWINGS

Further advantages and details of the invention are explained in the patent claims and in the description and are illustrated in the drawings, in which:

DETAILED DESCRIPTION OF THE INVENTION

Figure 1:
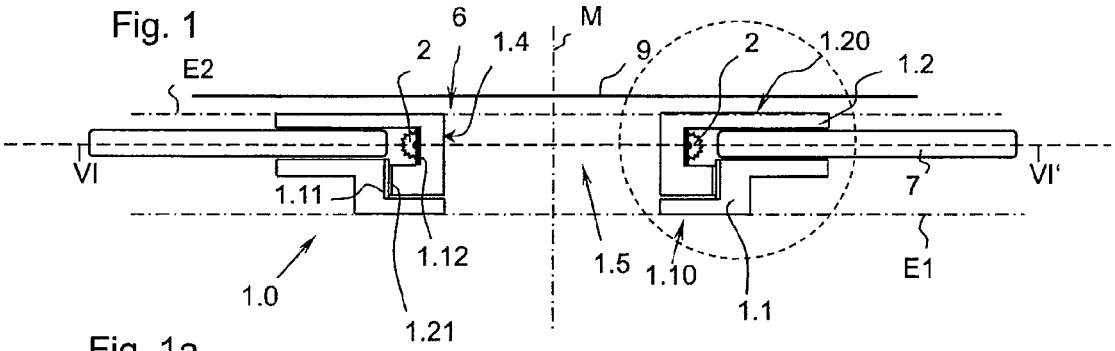
FIG. 1 shows a side view of a console that is mounted to a mounting surface and includes a light-emitting means and a light-conducting component.
Figure 1A:
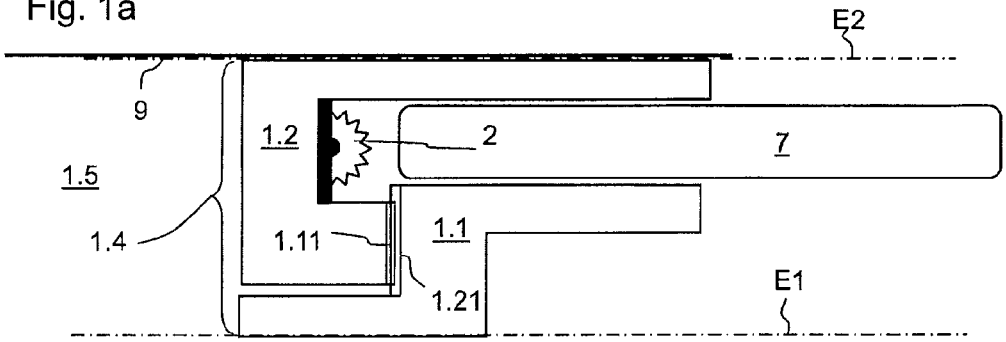
FIG. 1*a* shows a detailed view according to FIG. 1.

FIGS. 1 to 4 show sectional views of different consoles 1. Each console 1 comprises a frame element 1.0 that includes an upper part 1.1 and a lower part 1.2. The upper part 1.1 comprises a front side 1.10 and the lower part 1.2 comprises a rear side 1.20. The rear side 1.20 of the frame element 1.0 is secured to a mounting surface 9 that constitutes a ceiling. The front side 1.10 defines a plane E1 that is perpendicular to the central axis M, and the rear side 1.20 defines a plane E2 that is also perpendicular to the central axis M.

The frame element 1.0 comprises two parts in the axial direction of the central axis M. The upper part 1.1 is secured, in the axially downward direction, to the lower part 1.2 that is secured to the mounting surface 9. The connection between the two parts 1.1, 1.2 consists of an external thread 1.21 that is provided on the lower part 1.2 and a corresponding internal thread 1.11 that is provided on the upper part 1.1. The threads 1.11, 1.21 extend around the central axis M in the circumferential direction and the upper part 1.1 is screwed onto the lower part 1.2. A continuous groove 1.3 that is open towards the outside in the radial direction is formed between the lower part 1.2 and the upper part 1.1.

Figure 2:
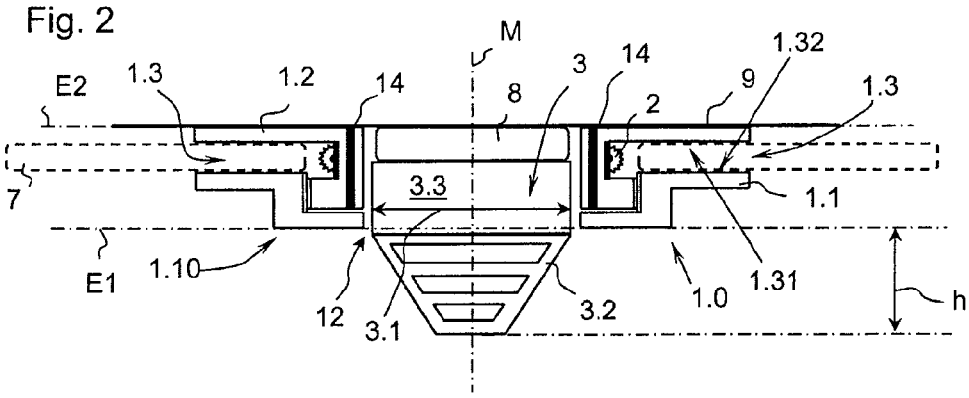
FIG. 2 shows a console according to FIG. 1, including a smoke detector as a signalling means and a spacer between the mounting surface and the smoke detector.
Figure 3:
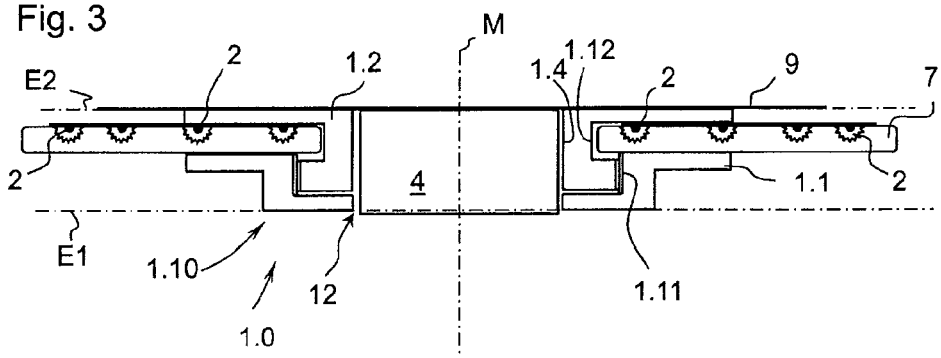
FIG. 3 shows a console according to FIG. 1, including a central lamp as a signalling means and a light-conducting component that incorporates the light-emitting means.

The light-emitting means 2 are positioned in this groove 1.3 on an outer side 1.12 of the frame element 1.0, as shown in FIGS. 1-3, so that light will be emitted towards the outside in the radial direction.

Figure 4:
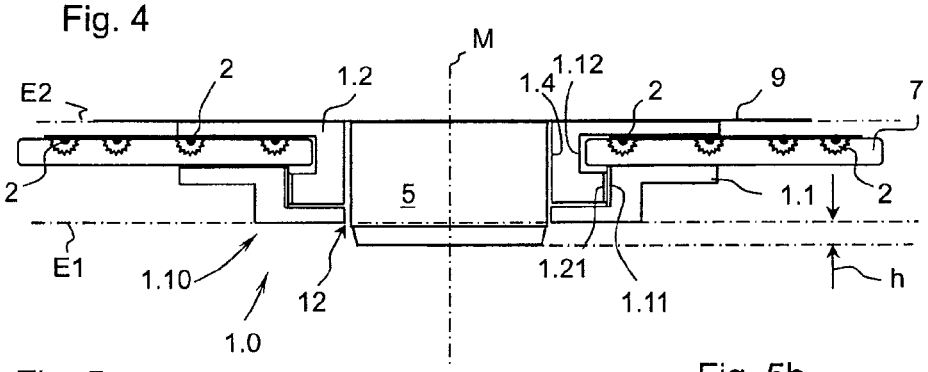
FIG. 4 shows a console according to FIG. 3, including a central loudspeaker.

The frame element 1.0 comprises a central recess 1.5 (FIG. 1*a*) that is coaxial with the central axis M and is designed as a through opening. As is also shown in detail in FIG. 1*a*, the recess 1.5 is defined by an inner side 1.4 of the frame element 1.0. A signalling means 3-5 is positioned in the recess 1.5, as shown in FIGS. 2-4. In this way, the signalling means 3-5 is centrally arranged in the frame element 1.0, adjacent to the inner side 1.4 of the frame element 1.0 in the radial direction, and is secured to the same mounting surface 9 as the frame element 1.0 in the upward direction. For the sake of clarity, the mounting surface 9 is shown at a distance from the rear side 1.20 of the frame element 1 in the sketch. The mounted position is shown in FIGS. 1*a*-4.

For thermal reasons, the diameter 3.1 of the smoke detector 3 shown in FIG. 2 is dimensioned in such a manner that an air gap 12 of between 0.5 mm and 1.2 mm is provided between the inner side 1.4 of the frame element 1.0 and the smoke detector 3. The smoke detector 3 has a slotted smoke cap 3.2 and an adjacent housing 3.3. The housing 3.3 of the smoke detector 3 is also secured to the mounting surface 9. The smoke cap 3.2 protrudes downwardly beyond the front side 1.10 of the frame element 1.0 by a length h of 34 mm in the direction of the central axis M. As a result, the smoke detector 3 is arranged in the shadow, i.e. shielded from the radiation emitted by the light-emitting means 2. As the light-emitting means 2 are arranged between the two planes E1, E2 that are defined by the front side 1.10 and the rear side 1.20, it is easy to ensure that the radiation is emitted in the radial direction, away from the smoke detector 3. The air gap 12 is also provided in all other signalling means that are arranged in the recess 1.5 of the console 1 and are combined with the console 1 in a modular fashion.

A light-conducting component 7 is supported in the groove 1.3 between the upper part 1.1 and the lower part 1.2 in the groove 1.3. The two parts 1.1, 1.2 form a first side wall 1.31 of the groove and a second side wall 1.32 of the groove, between which the component 7 is secured. The component 7 can be made of glass, plastic, natural stone or any other light-conducting material. Preferably, glass is used since it has very good thermal conductivity, thus transporting the heat generated by the light-emitting means 2 in a direction away from the smoke detector 3.

In the exemplary embodiment according to FIG. 3, the light-emitting means 2 are arranged in the component 7. The light-emitting means 2, which are shown on both sides of the central axis M and are positioned within the groove 1.3 in each case, cannot emit light directly onto the signalling means 4 since the signalling means 4 is arranged in the shadow, i.e. shielded from the radiation, due to the groove 1.3. The heat generated by the light-emitting means 2, which may be disadvantageous for the signalling means 4 regardless of the shadow, i.e. the area that is shielded from the radiation, is absorbed by the frame element 1.0 and transferred to the air. The light-emitting means 2 that are at a greater distance from the signalling means 4 in the radial direction do not pose a problem with regard to the light emitted onto the signalling means 4. The adverse effect of the heat that is generated also decreases as the distance of the light-emitting means 2 from the signalling means 4 increases. In an exemplary embodiment not shown, the light-emitting means according to either of FIGS. 1 to 2 are combined with the light-emitting means 2 according to FIG. 3 in one frame element 1.0.

In another exemplary embodiment not shown, the upper part 1.1 is not secured to the lower part 1.2 by means of a thread but by pushing it onto the lower part 1.2 in the axial direction, thus securing the component 7 in the groove 1.3. In this exemplary embodiment, as well as in the previous exemplary embodiment, the light-emitting means 2 can be positioned on the lower part 1.2 or on the upper part 1.1.

If combined with a smoke detector 3 according to FIG. 2, the system additionally comprises a spacer 8 that is arranged between the mounting surface 9 and the smoke detector 3. The spacer 8 serves to adjust the smoke detector 3 in its position relative to the front side 1.10 or to the plane E1 in the axial direction of the central axis M.

Furthermore, an insulation layer 14 is provided in the lower part 1.2 in the exemplary embodiment according to FIG. 2. For this purpose, the lower part 1.2 comprises several parts in the radial direction, so that the insulation layer 14 prevents heat from being transferred from the light-emitting means 2 in the radial direction towards the inside through the continuous insulation layer 14.

Figure 6:
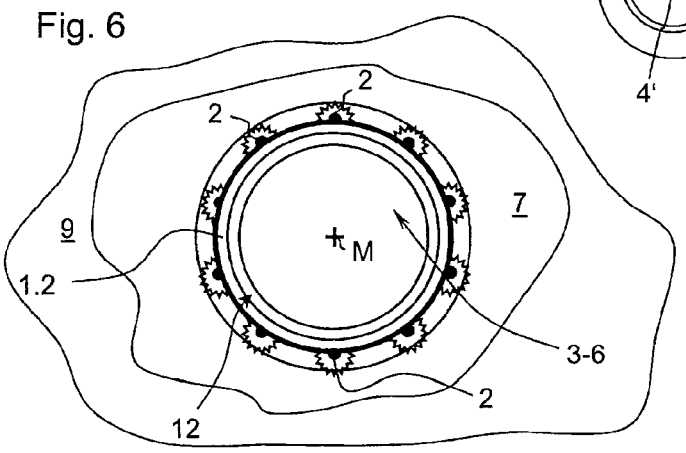
FIG. 6 shows a side view in the direction of the central axis in case of a section along line VI-VI' of FIG. 1.

FIG. 6 shows a view of the console 1 in case of a section along line VI-VI' of FIG. 1, including a smoke detector 3 according to FIG. 2. The component 7, whose circumferential contour is indicated by a free-form line, is shown cut off in the radial direction. The circumferential contour can have any desired symmetric or asymmetric shape taking into account the thermal characteristics.

Several consoles 1 are connected to each other in a modular fashion and light-conducting manner by means of the component 7 or an intermediate component 13. The signalling means 3-6 are logically linked to each other by means of an electronic control unit. For example, FIGS. 5*a*-5*c* show several such consoles 1, 1', 1" including different signalling means 3-5 in the recesses 1.5, which consoles constitute a safety system in case of fire.

Figure 5A:
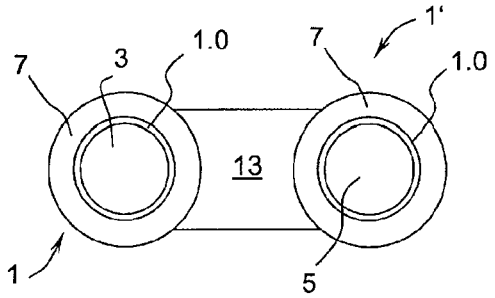
FIG. 5*a* shows a safety system comprising two consoles that are combined in a modular fashion and are connected to each other in a light-conducting manner by means of an intermediate component.
Figure 5B:
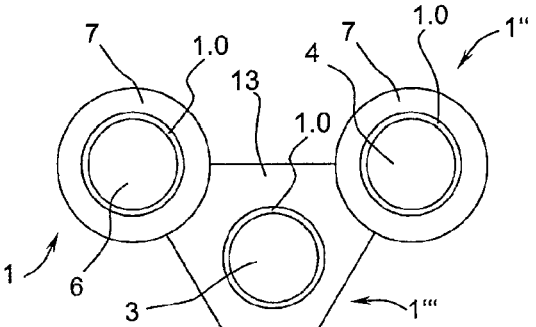
FIG. 5*b* shows a safety system comprising three consoles that are combined in a modular fashion and are connected to each other in a light-conducting manner by means of an intermediate component.

According to FIG. 5*a*, a first console 1 is combined with a smoke detector 3 that transmits an electronic signal to a control unit (not shown) that will then control a loudspeaker 5 arranged in a second console 1' to make an announcement. According to FIG. 5*b*, another console 1" is added to the module by means of a component 7 and a fourth console 1'" is added by means of an intermediate component 13. The intermediate component 13 connects all components 7 in a light-conducting manner. The smoke detector 3 is arranged in the intermediate component 13, one console 1' accommodates a lamp 4 and the other console 1" accommodates a camera 6.

Figure 5C:
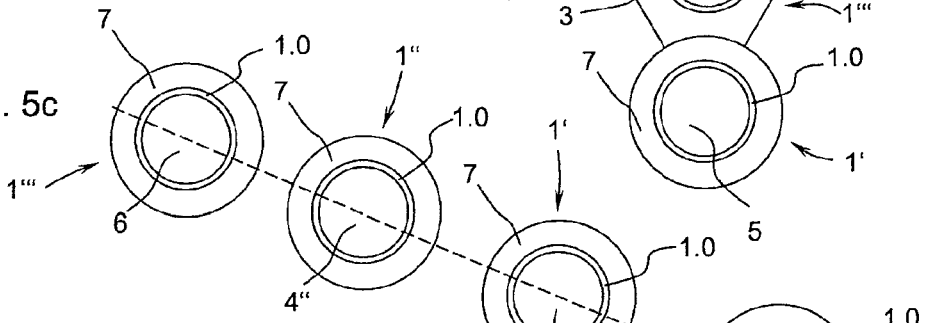
FIG. 5*c* shows a safety system comprising four consoles that are combined in a modular fashion and are connected to each other by means of an electronic control unit.

According to the exemplary embodiment shown in FIG. 5*c*, several lamps 4, 4', 4" are arranged in several consoles 1, 1', 1" at the same time. The lamps 4, 4', 4" blink at different frequencies, so that a blinking sequence aligned in the direction of the escape route (arrow), i.e. a moving optical signal, is generated, which may possibly change colour. Such moving optical signals form light corridors or signal lines that serve to indicate the escape route. A camera 6 is inserted in another console 1'" as a signalling means for monitoring the emergency.

In FIGS. 1 to 6, identical parts have identical reference numerals. Where not all identical parts are identified, the reference numerals have been omitted for the sake of clarity.

What is claimed is:

1. A console, comprising: one or more light-emitting devices that are intended to be combined with one or more identical or different signalling devices, the console having at least one first frame element including an upper part with a front side and a lower part with a rear side that is intended to be mounted to a mounting surface, and a first light-emitting device that is directly or indirectly arranged on the frame element, wherein the frame element a) comprises at least two parts in a direction of a central axis (M) and comprises at least one groove between the front side and the rear side, which groove extends at least partially around the central axis on an outer side, wherein the groove has an outer side, the outer side defining a bottom of the groove and b) at least one of the light-emitting devices is arranged in the groove in the area of the outer side, and c) the frame element comprises a recess, which extends in the axial direction of the central axis (M) across a height of the frame element, the recess includes an inner side which limits the recess, which recess serves to accommodate an electrical signalling device, wherein the frame element insulates and shields via the inner side the signalling means device from heat that is generated by the light-emitting devices and is transferred by conduction or convection.

2. The console according to claim 1, wherein the upper part forms a first side wall of the groove and the lower part forms a second side wall of the groove.

3. The console according to claim 2, wherein the upper part and the lower part are connected to each other at least in the axial direction of the central axis (M), wherein the groove is divided due to said connection.

4. The console according to claim 3, wherein the frame element is made of a material whose thermal conductivity is not higher than 1 W/(m*K) or is at least 10 W/(m*K).

5. The console according to claim 4, wherein the frame element comprises an insulation layer that is arranged in the radial direction, relative to the central axis (M), between an inner side and the light-emitting device.

6. The console according to claim 5, wherein a light-conducting component is supported in the groove, which component extends in the radial direction, relative to the central axis (M), between two planes (E1, E2) of the front and rear sides.

7. The console according to claim 6, wherein the size of the front side and/or the mass of the frame element is/are dimensioned in accordance with heat introduced by the light-emitting device, in such a manner that a surface temperature of the frame element is max. 46° Celsius on the front side when the ambient temperature is up to 20° Celsius.

8. The console according to claim 1, wherein the upper part and the lower part are connected to each other at least in the axial direction of the central axis (M), wherein the groove can be divided due to said connection.

9. The console according to claim 1, wherein the frame element is made of a material whose thermal conductivity is not higher than 1 W/(m*K) or is at least 10 W/(m*K).

10. The console according to claim 1, wherein the frame element comprises an insulation layer that is arranged in the radial direction, relative to the central axis (M), between an inner side and the light-emitting device.

11. The console according to claim 1, wherein a light-conducting component is supported in the groove, which component extends in the radial direction, relative to the central axis (M), between two planes (E1, E2) of the front and rear sides.

12. A modular system including several consoles according to claim 11, wherein the consoles are connected to each other by the light-conducting components so as to achieve a direct or indirect mechanical and/or light-conducting connection.

13. A safety system including one or several consoles or of a modular system according to claim 12 and an electrical signalling device that is positioned in the recess, wherein the signalling device is designed as a smoke detector or smoke alarm.

14. The safety system according to claim 13, wherein an air gap of between 0.5 mm and 1.2 mm is provided between the frame element and the smoke detector or smoke alarm in any desired direction.

15. A safety system according to claim 13, including an electronic control unit, wherein at least one first signalling device can transmit an electronic signal to the electronic control unit, and the electronic control unit causes a second signalling device to output an acoustic and/or optical signal.

16. A safety system according to claim 13, wherein one or several light-emitting devices and/or lamp(s) change their characteristics in accordance with one or several signal(s) of a smoke detector.

17. A safety system according to claim 13, wherein the characteristics of the light-emitting device and/or the lamps of at least one console are controlled in accordance with the characteristics of the light-emitting device and/or the lamps of another console.

18. A modular system including several consoles according to claim 11, wherein an intermediate component is provided between at least two consoles, which intermediate component serves to connect at least two of the light conducting components so as to achieve a mechanical and/or light-conducting connection.

19. The console according to claim 1, wherein the size of the front side and/or the mass of the frame element is/are dimensioned in accordance with heat introduced by the light-emitting device, in such a manner that a surface temperature of the frame element is max. 46° Celsius on the front side when the ambient temperature is up to 20° Celsius.

20. A safety system according to claim 1, wherein the signalling device is designed as a lamp or as a loudspeaker or as a camera or as another electrical or hydraulic signalling means, wherein the lamp, the loudspeaker or the camera comprises a housing whose diameter corresponds to a diameter of the housing of the smoke detector or smoke alarm.

* * * * *